US011382365B2

(12) United States Patent
Musgrove

(10) Patent No.: US 11,382,365 B2
(45) Date of Patent: Jul. 12, 2022

(54) GLOVE ATTACHMENT SYSTEM

(71) Applicant: Ansell Limited, Richmond (AU)

(72) Inventor: Christopher Alan Musgrove, Redhill (GB)

(73) Assignee: ANSELL LIMITED, Richmond (AU)

( * ) Notice: Subject to any disclaimer, the term of this patent is extended or adjusted under 35 U.S.C. 154(b) by 399 days.

(21) Appl. No.: 16/338,898

(22) PCT Filed: Oct. 25, 2017

(86) PCT No.: PCT/AU2017/000229
§ 371 (c)(1),
(2) Date: Apr. 2, 2019

(87) PCT Pub. No.: WO2018/076041
PCT Pub. Date: May 3, 2018

(65) Prior Publication Data

US 2021/0282471 A1 Sep. 16, 2021

Related U.S. Application Data

(60) Provisional application No. 62/414,164, filed on Oct. 28, 2016.

(51) Int. Cl.
*A41D 13/00* (2006.01)
*A41D 19/00* (2006.01)

(52) U.S. Cl.
CPC ..... *A41D 13/0005* (2013.01); *A41D 19/0089* (2013.01)

(58) Field of Classification Search
CPC .. A41D 13/0005; A41D 19/0089; A43B 7/12; A43B 3/04; A62B 17/001; B63C 11/04; B63C 2011/043; B63C 2011/046
See application file for complete search history.

(56) References Cited

U.S. PATENT DOCUMENTS 2,813,272 A * 11/1957 Hagan ..... A41D 19/0089 285/260
3,009,164 A 11/1961 Frey
(Continued)

FOREIGN PATENT DOCUMENTS

DE 19701343 A1 * 7/1998 ..... B63C 11/04
WO WO-9639055 A1 * 12/1996 ..... A61B 42/10
WO WO-2012039463 A1 3/2012

OTHER PUBLICATIONS

Lakeland Industries, Lakeland Push-Lock Glove System, accessed via https://www.youtube.com/watch?v=4n4Jw47WPew (last visited Jul. 28, 2021). (Year: 2016).*
(Continued)

*Primary Examiner* — Alissa L Hoey
*Assistant Examiner* — Patrick J. Lynch
(74) *Attorney, Agent, or Firm* — Moser Taboada

(57) ABSTRACT

A glove attachment system that includes a hollow frustoconical inner member having a plurality of ribs and a plurality of grooves disposed on an external surface of the hollow frustoconical inner member, and a sealing collar for joining gloves to sleeves is disclosed, wherein the plurality of ribs and the plurality of grooves of the hollow frustoconical inner member and the plurality of ribs and a plurality of grooves of the sealing collar are configured to mate and releasably join a sleeve and a glove that are radially compressed between the plurality of ribs and the plurality of grooves of the hollow frustoconical member and the plurality of ribs and the plurality of grooves of the sealing collar, and wherein the sleeve and the glove are separately formed and extend in opposite directions.

17 Claims, 8 Drawing Sheets

(56) References Cited

U.S. PATENT DOCUMENTS

| | | | | | |
|---|---|---|---|---|---|
| 3,525,334 | A * | 8/1970 | Scott | A41D 13/0025 | 128/201.25 |
| 3,744,158 | A * | 7/1973 | Walker | A43B 7/12 | 36/1.5 |
| 3,889,297 | A * | 6/1975 | Jarboe | A41D 19/0041 | 2/16 |
| 4,399,567 | A | 8/1983 | Sohn | | |
| 5,090,057 | A * | 2/1992 | Aldridge | A41D 13/0005 | 2/227 |
| 5,978,960 | A * | 11/1999 | Wrightman | A41D 13/0005 | 2/2.15 |
| 6,530,090 | B1 * | 3/2003 | Ambrose | A41D 13/1209 | 2/125 |
| 7,302,711 | B1 | 12/2007 | Tanenbaum | | |
| 2002/0178485 | A1 | 12/2002 | Medves | | |
| 2002/0189007 | A1 | 12/2002 | Cormier | | |
| 2003/0188368 | A1 * | 10/2003 | Stinton | A41D 13/012 | 2/2.16 |
| 2009/0126075 | A1 | 5/2009 | Knuth et al. | | |
| 2012/0324621 | A1 | 12/2012 | McLachlan | | |
| 2015/0197324 | A1 * | 7/2015 | Marlin | A41D 13/012 | 2/2.16 |

OTHER PUBLICATIONS

International Search Report for PCT Application No. PCT/AU2017/000229 dated Feb. 1, 2018.

* cited by examiner

GLOVE ATTACHMENT SYSTEM

FIELD

Embodiments of the present disclosure generally relate to connection devices and, more particularly, to devices for attaching gloves with articles, such as sleeves, protective suits, and/or rubber and fabric articles.

BACKGROUND

Protective suits, such as HAZMAT suits, splash suits, tactical suits for law enforcement, gas tight suits, and other encapsulating suits are used in many hazardous environments to protect wearers from chemical and/or gaseous hazards and/or nuclear particles. However, different environments may require lesser or greater requirements for gloves for use with the suits. For example, a glove having relatively low barrier protection properties and high dexterity requirements or vice-versa might be desired. Furthermore, gloves are further specified for specific applications, e.g., different chemicals, fire hazards, gripping requirements, and the like. Because no one glove can fulfill these requirements, a user needs several types of protective suits and several types of gloves for different environments, which is expensive. Past attempts at securing gloves to suits have lacked features to provide a releasable mechanism and/or a reliable, secure seal for multiple glove thicknesses and suit/sleeve thicknesses.

A device capable of reliably and releasably joining a variety of differently sized gloves to differently sized protective suits represents an advance in the art.

SUMMARY

Embodiments of the disclosure comprise a glove attachment system, substantially as shown in and/or described in connection with at least one of the figures, as set forth more completely in the claims. Various advantages, aspects and novel features of the present disclosure, as well as details of an illustrated embodiment(s) thereof, will be more fully understood from the following description and drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
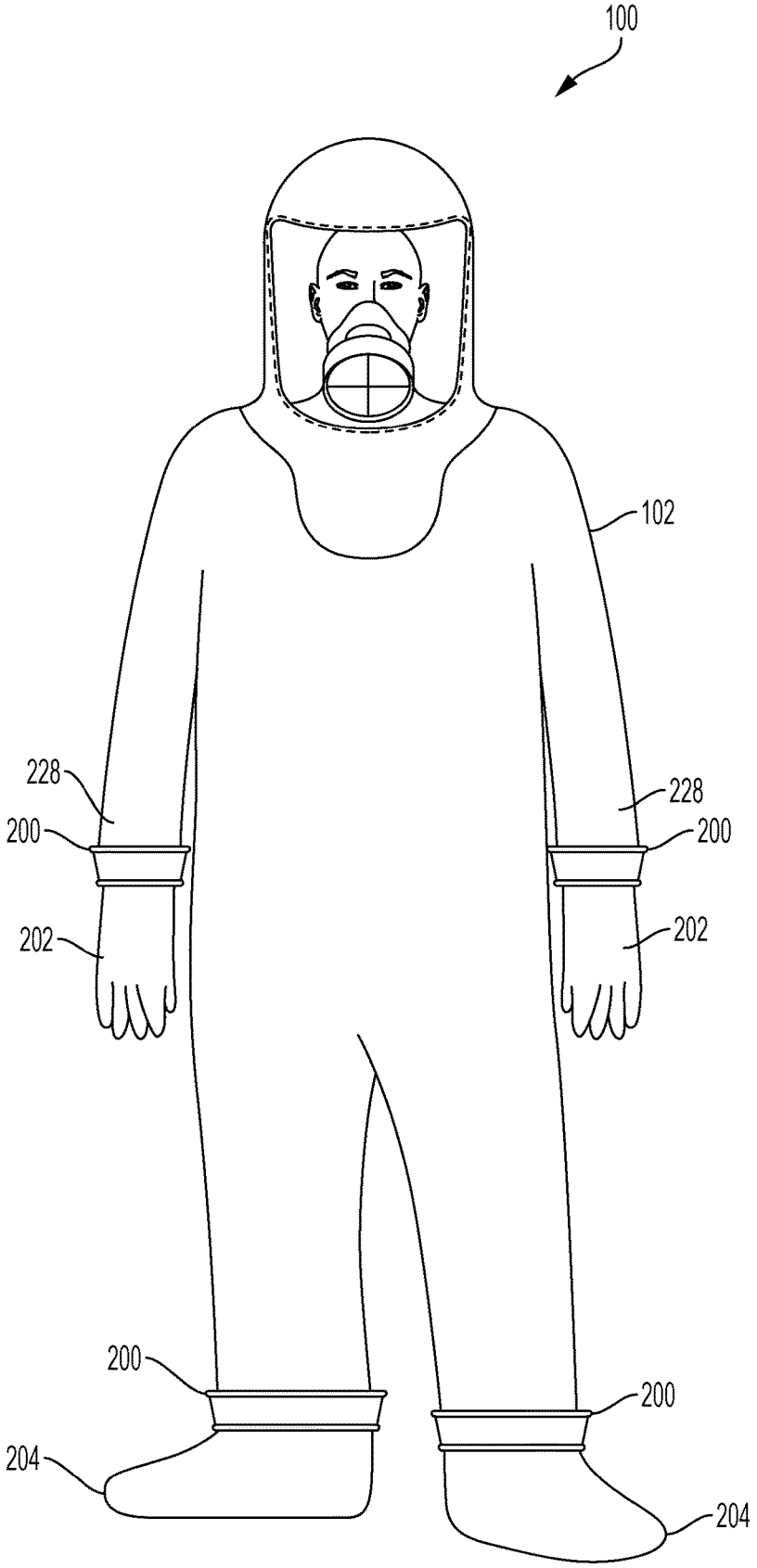
FIG. 1 shows personal protective equipment, comprising an exemplary protective suit having a glove attachment system, according to embodiments of the disclosure.

Those skilled in the art will recognize that the disclosure is not limited to the embodiments of drawing or drawings described. It should be understood that the appended drawings and detailed description, which illustrate only typical embodiments of the disclosure thereto, are not intended to limit the disclosure to the particular form disclosed, but on the contrary, the disclosure is to cover all modifications, equivalents and alternatives falling within the spirit and scope of the present disclosure. The appended drawings and detailed description are therefore not to be considered limiting of its scope, for the disclosure may admit to other equally effective embodiments. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

Embodiments of the disclosure comprise glove attachment systems. The glove attachment systems can be used to releasably attach gloves to, for e.g., protective suits and/or other apparel, such as sleeves. Glove attachment systems may optionally be used to attach gloves to sleeves within fume hoods, biosafety cabinets, or glove boxes for releasably attaching sleeves and gloves within the hoods, cabinets, and/or boxes. The materials that the protective suits, or the sleeves within fume hoods, biosafety cabinets, or glove boxes, are made range from very thin to very thick. Also, some gloves have gauntlets or cuffs that range from very thin to very thick. Therefore, the inventors have provided a glove attachment system capable of joining thin gloves with thin suits; thick gloves with thick suits, thin gloves with thick suits, and thick gloves with thin suits. Furthermore, the inventors have provided a glove attachment system having ribs and/or grooves. The glove attachment system having ribs and/or grooves provide an audible click when the glove is securely attached to or released from the sleeve of a suit or sleeve, providing valuable feedback to the user. The glove attachment system, according to embodiments of the disclosure, attaches the glove to a protective suit or sleeve, creating a splash tight seal. In any embodiment, the glove attachment system allows the releasable separation of the suit or sleeve to the glove, providing the benefit of re-usability, which is especially valuable for low cost disposable suits but where expensive gloves are necessary. Also, for any embodiment of the disclosure, the glove attachment system allows the releasable separation of the suit or sleeve to the glove, providing the benefit of re-usability, which is especially valuable for high cost suits but where changing inexpensive gloves is necessary. Also, different gloves for different chemical environments, having different grip properties, may be joined with a plurality of different types of suits. Any and all embodiments of the disclosure are adapted to and are capable of providing a liquid tight seal between a glove and a sleeve or suit.

FIG. 1 shows personal protective equipment 100, comprising an exemplary protective suit 102 having a glove attachment system 200, according to embodiments of the disclosure. The personal protective equipment 100 comprises a glove attachment system 200 attached to the protective suit 102 at a sleeve 228. The glove attachment system 200 comprises a frustum of a right circular cone, i.e., a frustoconical member having the shape of a hollow cone with the narrow end, or tip, truncated, and a ring-like sealing collar, as shown below, for attaching a glove 202 and/or a boot 204 to a sleeve or a pantleg. The glove attachment system 200 can, with minor changes to the design, e.g., sizes of components, be used to attach boots to suits. The glove attachment system 200 can attach a mask to a protective suit. Furthermore, two halves of a suit can be releasably joined with a similar attachment system. For example, a suit cut in half at a waist area. Embodiments according to the disclosure comprise a frustoconical inner member having outer ribs and/or grooves and a sealing collar having inner ribs and/or grooves for mating with the outer ribs and/or grooves of the frustoconical member, as shown below.

The protective suit 102, or any sleeve, comprises materials, such as laminated fabrics having barrier properties and/or the like, such as materials, protective suits, and technologies disclosed in commonly assigned U.S. Pat. Nos. 7,921,467; 8,247,077; 8,268,451; and 8,505,112; the technology of each is incorporated by reference herein. Any of these materials may be coated with, for example, a barrier layer, such as a polymeric material. The thickness in millimeters (mm) of materials of which the protective suit 102 is comprised ranges from, for example, 0.25 mm to 3.0 mm. Gloves for use with such a suit or hood may have a thickness of 0.18 mm to 3.0 mm. For example, an ALPHATEC® 58-330 glove that is approximately 0.40 mm in thickness, a MICROFLEX® glove that is approximately 0.40 mm in thickness, made and marketed by Ansell Limited, a Comfort Z51G glove made by Marigold Industrial/Comasec, which is approximately 1.4 mm in thickness, and/or many others. Thinner gloves and thinner suits may also be releasably connected by the glove attachment system 200, without departing from embodiments of the disclosure. For example, gloves may be as thin or thinner than 0.05 mm and still be releasably joined with a suit that is as thin or thinner than 0.05 mm. The protective suit 102 may be Level A, B, C, or D personal protective equipment as is known to those in the art and/or their EU equivalents. The protective suit 102 may be EN type 1-6 protective suits. For example, some protective suits 102 are Level A-Level D chemical suits and/or EN1-6 chemical suits, which may be made of various materials. These materials comprise, for e.g., single or multi-layer laminates, non-wovens, knitted or woven fabrics, and the like. The protective suit 102 may be for splash protection and/or biological protection and/or gas permeation protection and/or for flame and heat protection. The protective suit 102 comprises, optionally, double sleeves, i.e., an inner sleeve attached, for example, via a heat sealing tape, to an inside of an outer sleeve, wherein the outer sleeve protects the inner sleeve, for e.g., if the inner sleeve comprises a different material specified for protection against a different hazard than the outer sleeve. The inner sleeve may be formed differently, i.e., a non-woven, a woven, a knitted sleeve, etc. The inner sleeve may comprise a knitted cuff, for example, at a distal end of the inner sleeve for cut protection. The glove attachment system 200 discussed below may releasably engage the inner sleeve or the cuff on the distal end of the inner sleeve. Either or both of the inner sleeve or outer sleeve may comprise a cinched, elastomeric band around an end, for additional closure and protection.

Figure 2:
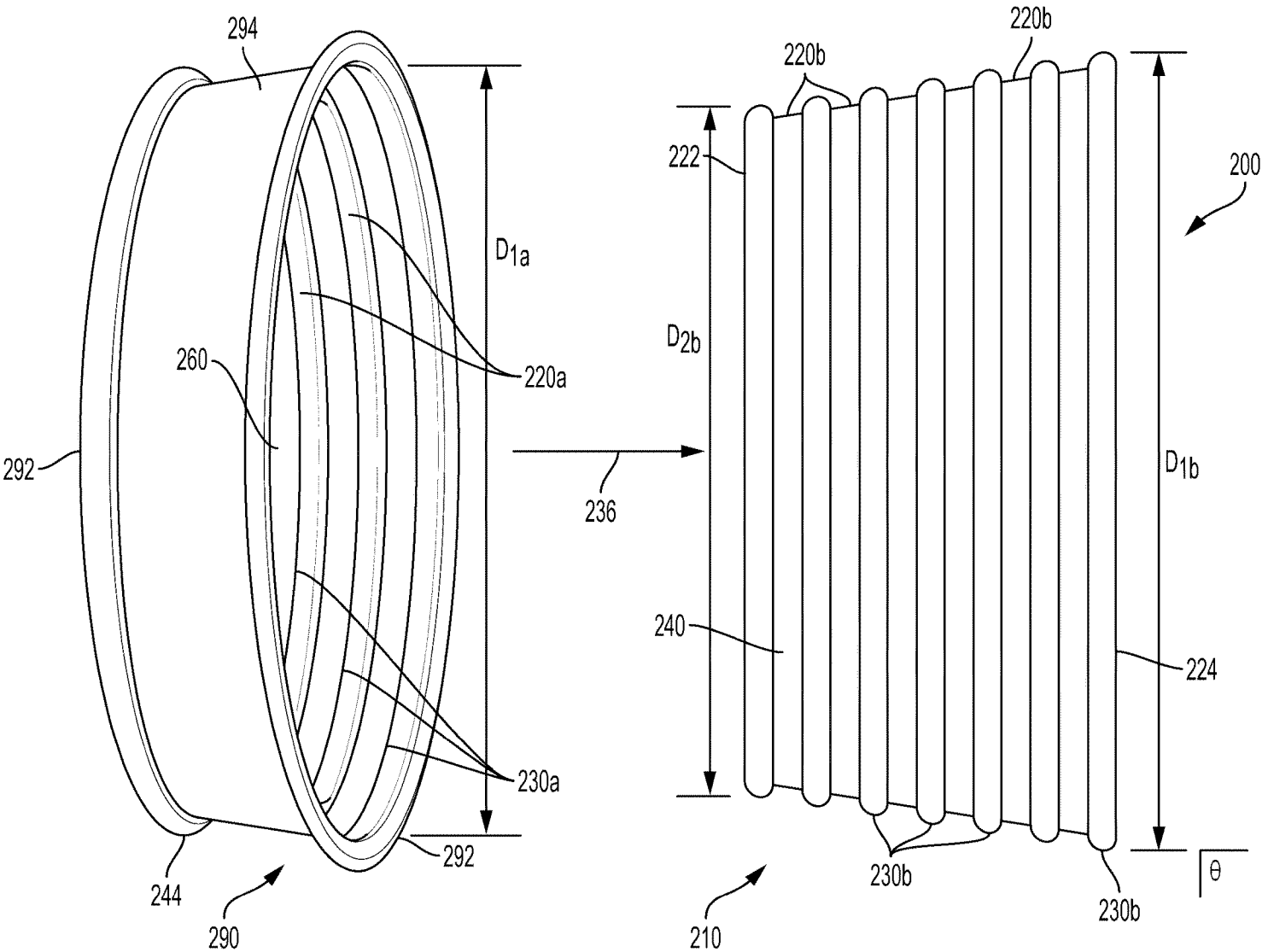
FIG. 2 depicts an exploded view of the glove attachment system of FIG. 1, according to embodiments of the disclosure.

FIG. 2 depicts an exploded view of the glove attachment system 200 of FIG. 1, according to embodiments of the disclosure. As shown, the glove attachment system 200 comprises the hollow frustoconical inner member 210 and the sealing collar 290. The hollow frustoconical inner member 210 has a plurality of concentric grooves 220*a* and a plurality of concentric ribs 230*a* disposed on an external surface 240. The hollow frustoconical inner member 210 has diameters ($D_{1b}$) . . . ($D_{2b}$) that decreases from a wide side 224 to a narrow side 222, forming a tapered hollow frustoconical inner member 210. The sealing collar 290, which is frustum-shaped, i.e., a tapered inner surface, has a plurality of concentric grooves 220*b* and a plurality of concentric ribs 230*b* disposed on an internal surface 260. At least one of the plurality of concentric grooves 220*b* and the plurality of concentric ribs 230*b* disposed on the internal surface 260 of the sealing collar 290 mate with at least one of the concentric grooves 220*a* and concentric ribs 230*a* disposed on the external surface 240 of the hollow frustoconical inner member 210. The mating of the groove and rib locks part of a sleeve of the protective suit 102 and a gauntlet or a cuff on a glove therebetween (or a boot/shoe with a distal end of a pantleg), as shown below. The sealing collar 290 comprises rails 292 disposed on an outer surface 294. The rails 292 have a larger outer diameter than the outer surface 294, allowing one more easily grip, engage and disengage the sealing collar 290 from the hollow frustoconical inner member 210. The glove attachment system 200 comprises the hollow frustoconical inner member 210 and the sealing collar 290, which mate to form a liquid tight seal.

An outer diameter of the hollow frustoconical inner member 210, as measured across a wide side 224 to a narrow side 222 decreases from, for example, in any embodiment according to the disclosure, across the ribs 230 on the wide side 224 from approximately 103 mm ($D_{1b}$) to 94 mm ($D_{2b}$)) for an outer diameter across the ribs 230 on the narrow side 222. In other words, diameters measured across the plurality of concentric ribs 230 are progressively larger from a first end of the hollow frustoconical inner member to a second end of the hollow frustoconical 0inner member. The grooves 220 between the ribs 230 are approximately 3-4 mm in width between adjacent ribs 230 and approximately 3 mm deep. The sealing collar 290 has an inner diameter. The inner diameter has the concentric grooves 220 and the concentric ribs 230 disposed on the internal surface 260. The inner diameter decreases from a large side 242 to a small side 244. For example, embodiments according to the disclosure may comprise an inner diameter, measured across the ribs 230 on the large side 242, that is approximately 104 mm ($D_{1a}$) and approximately 95 mm across an inner diameter (not shown) across the ribs 230 on the small side 244. In other words, diameters measured across the plurality of concentric ribs 230 are progressively larger from a first end of the sealing collar to a second end of the sealing collar.

Accordingly, there is a variety of gap sizes between a rib and a groove. For example, the distance between a gap formed between a groove 220*a* of the sealing collar 290 and a rib 230*b* of the hollow frustoconical inner member 210 may be less than 1 mm. However, the distance between a gap formed between a groove 220*a* of the sealing collar 290 and a rib 230*b* of the hollow frustoconical inner member 210 may be less than 1 mm. As the sealing collar 290 is pushed in direction 236, thinner and thinner combinations of gloves and sleeves can be releasably joined.

Figure 3:
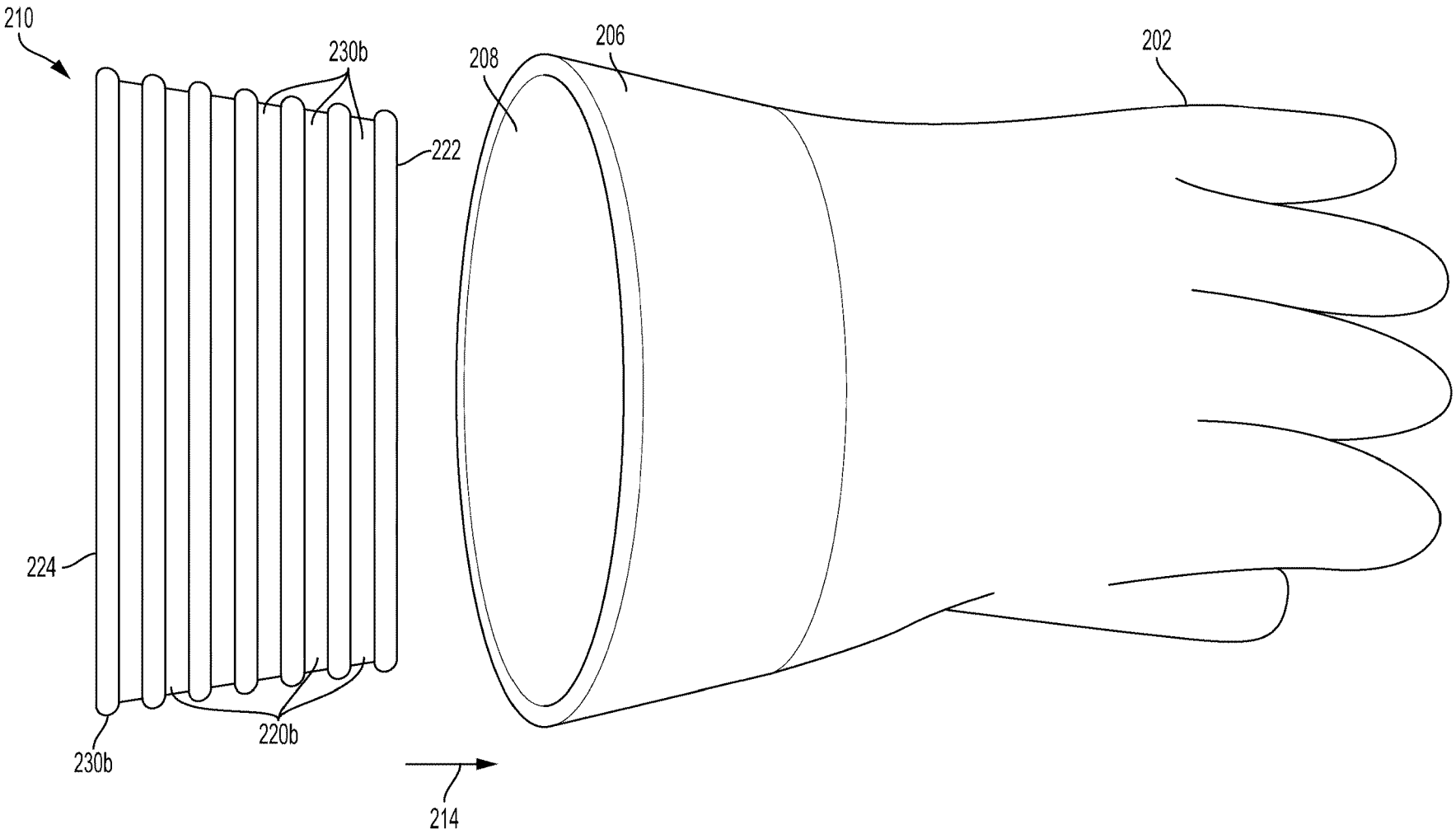
FIG. 3 shows an exploded view of a hollow frustoconical inner member of a glove attachment system within a glove, according to embodiments of the disclosure.

FIG. 3 shows an exploded view of a hollow frustoconical inner member 210 of a glove attachment system 200 within a glove 202, according to embodiments of the disclosure. The hollow frustoconical inner member 210, having the plurality of concentric grooves 220 and the plurality of concentric ribs 230, is delivered into an opening 208 adjacent to a cuff 206 of the glove 202. A narrow side 222, opposite a wide side 224, of the hollow frustoconical inner member 210 is introduced into the opening 208 first by forcing the hollow frustoconical inner member 210 in direction 214 to engage the cuff 206 of the glove 202. In this manner, the glove 202 may be of many different sizes or widths or thicknesses and still be used with the glove attachment system 200.

Figure 4:
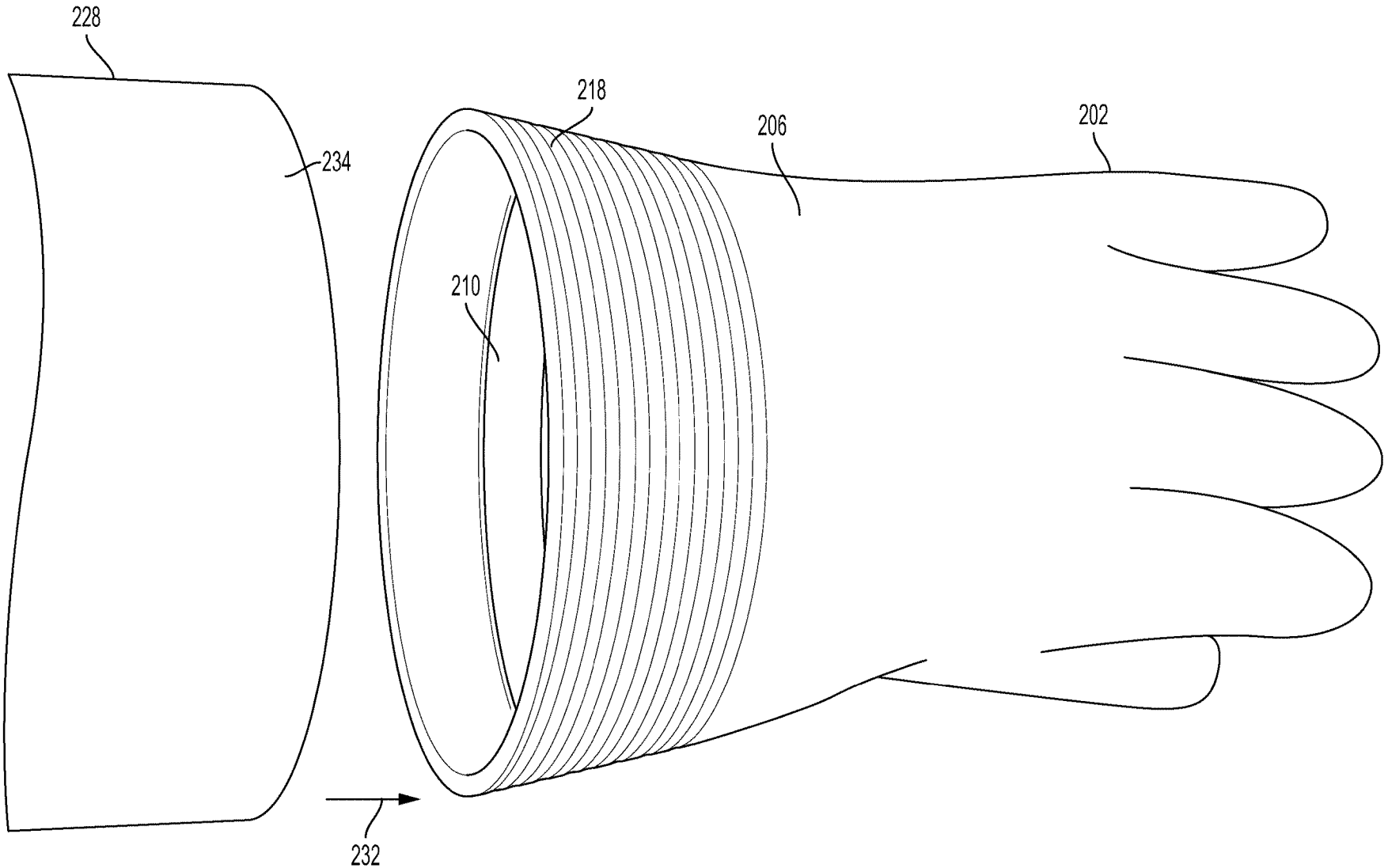
FIG. 4 shows an exploded view of a hollow frustoconical inner member of a glove attachment system disposed within a glove and an unattached sleeve, according to embodiments of the disclosure.

FIG. 4 shows an exploded view of a hollow frustoconical inner member 210 of a glove attachment system 200 disposed within a glove 202 and an unattached sleeve 228, according to embodiments of the disclosure. The unattached sleeve 228 is truncated for ease of display. Witness lines 218 (shown as dark lines) of the concentric ribs (not shown in this view) of the hollow frustoconical inner member 210 are shown on the cuff 206 of the glove 202. The witness lines 218 are to indicate that the hollow frustoconical inner member 210 comprises a fit within the glove 202. The sleeve 228, having a sleeve opening 234 of the protective suit 102, is fitted over the glove 202 having the hollow frustoconical inner member 210 disposed therein as shown by arrow 232.

Figure 5:
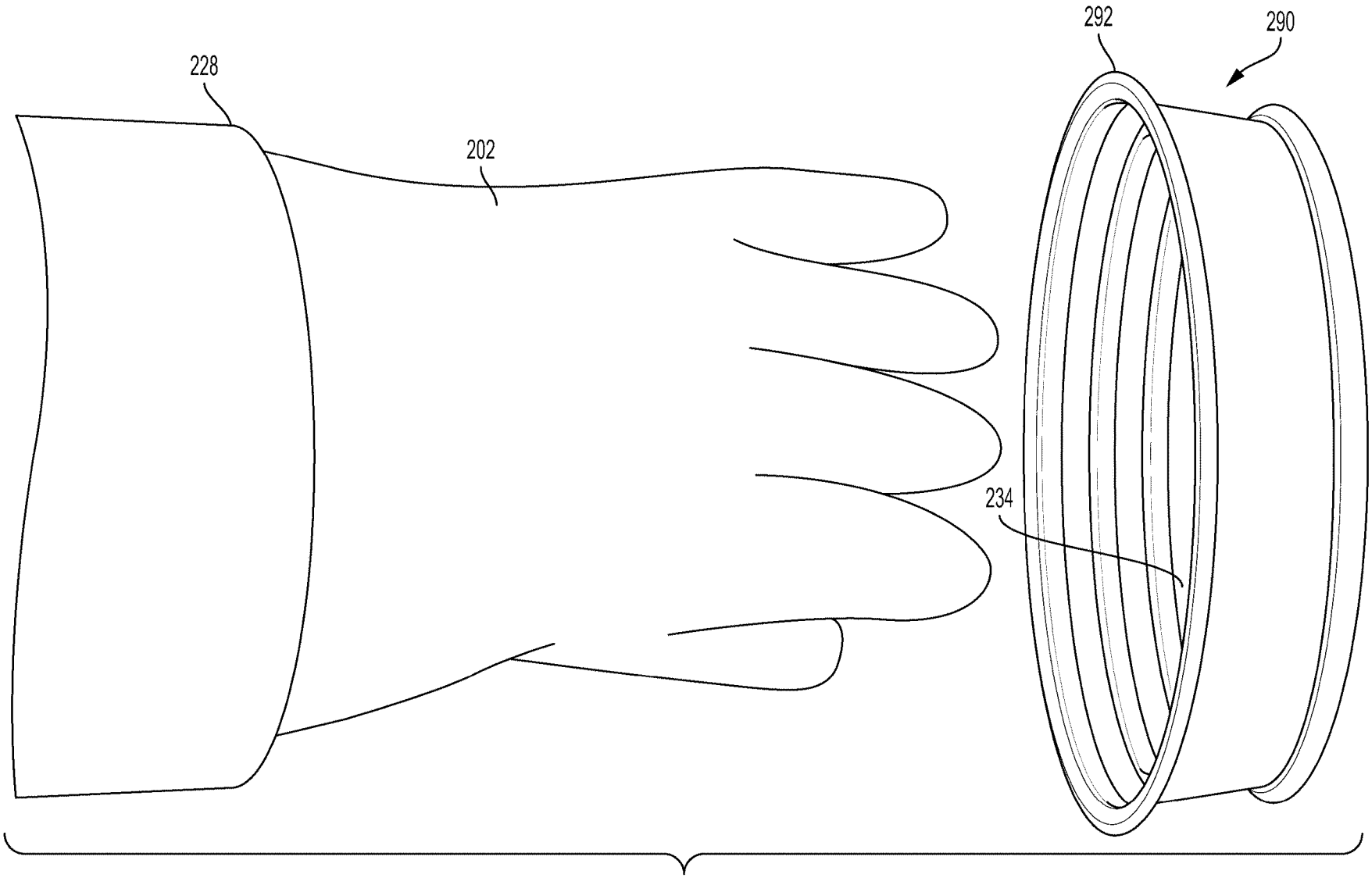
FIG. 5 shows a sealing collar of the glove attachment system in an exploded view with the glove of FIG. 4 and a sleeve, according to embodiments of the disclosure.

FIG. 5 shows a sealing collar 290 of the glove attachment system 200 in an exploded view with the glove 202 of FIG. 4 and a sleeve 228, according to embodiments of the disclosure. The sealing collar 290 is depicted before it is joined with the glove 202 and the sleeve 228. As can be seen, a wide opening 234 of the sealing collar 290 is disposed to fit over the glove 202 and the sleeve 228. A user can grip the sealing collar 290, for example, by the rail 292, delivering it past the glove 202, moving the sealing collar 290 in direction 296. The sealing collar 290 is forced over the sleeve 228 (and the cuff 206 of the glove 202, wherein the cuff is obscured by the sleeve 228 in this view). The sealing collar 290 becomes engaged with the hollow frustoconical inner member (not shown). The sleeve 228 becomes joined with the glove 202 after mating with the concentric ribs (not shown) of the hollow frustoconical inner member (not shown) disposed within the glove 202, as shown more fully below.

Figure 6A:
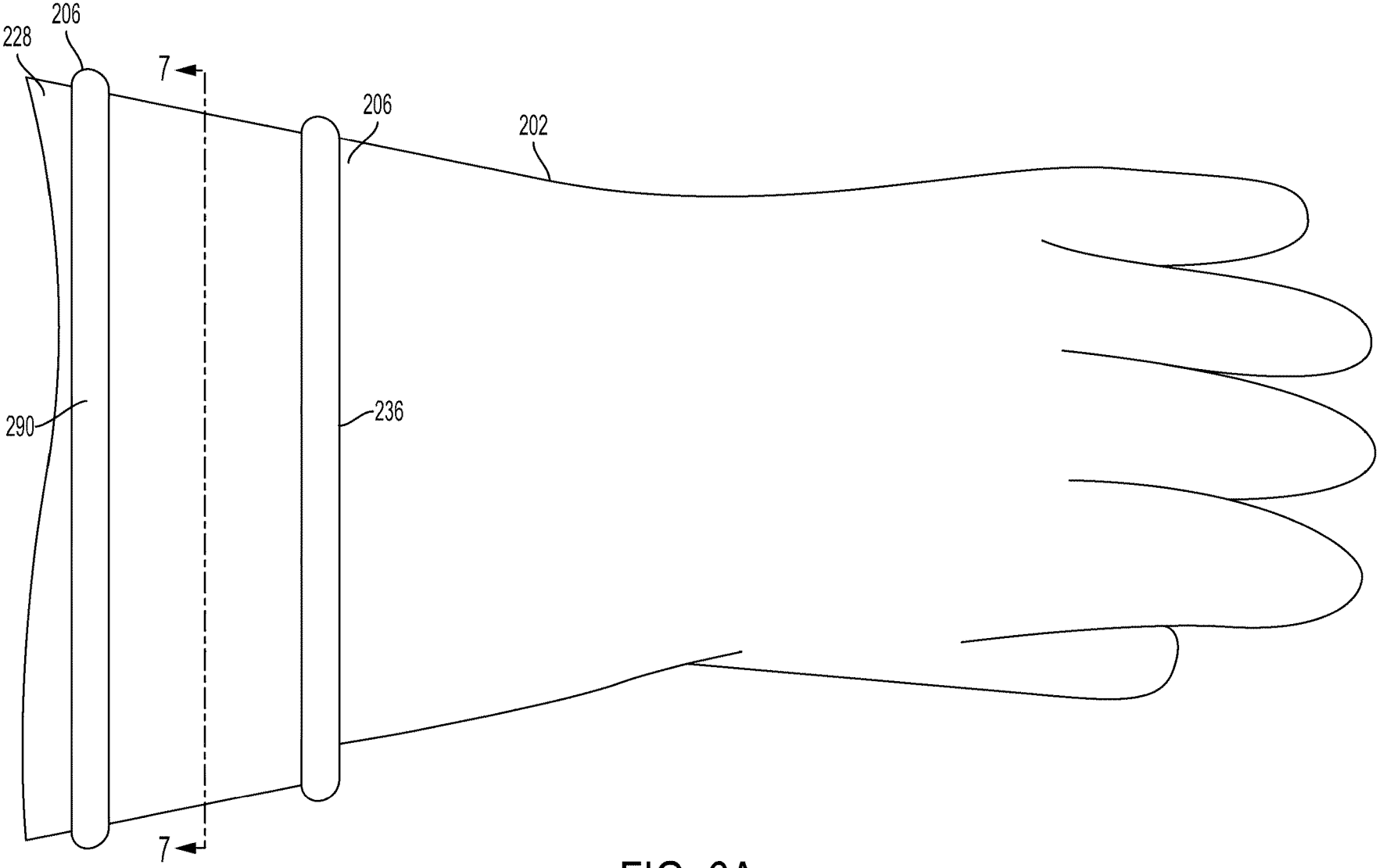
FIG. 6A shows an assembled view of the glove attachment system, in which the sealing collar is disposed over a sleeve and a cuff of the glove, in accordance with embodiments of the disclosure.

FIG. 6A shows an assembled view of the glove attachment system 200, in which the sealing ring 290 is disposed over the sleeve and the cuff of the glove, in accordance with embodiments of the disclosure. As shown, a distal end 236 of the sleeve 228 extends from the sealing collar 290, partially covering the cuff 206 of the glove 202. As shown, the sleeve 228 is disposed inside the sealing collar 290. The protective suit 102 may comprise, as stated above, an additional sleeve (not shown), disposed over the sleeve 228, which covers the sleeve 228 and the sealing collar 290.

Figure 6B:
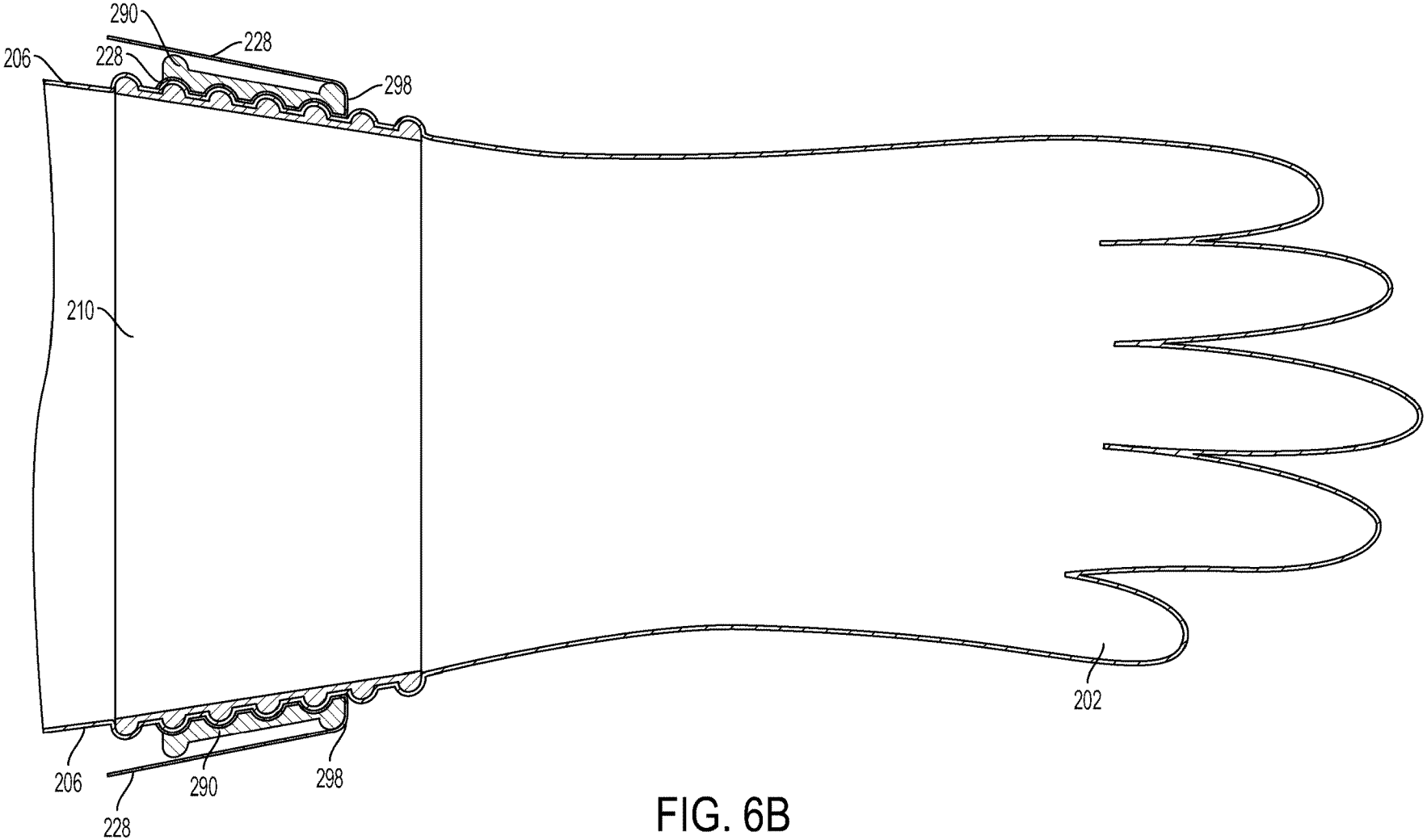
FIG. 6B shows an alternative assembled sectional view of the glove attachment system, in which the sleeve is disposed over and through the sealing collar, in accordance with embodiments of the disclosure.

FIG. 6B shows an alternative assembled sectional view of the glove attachment system 200, in which the sleeve 228 is disposed over and through the sealing collar 290, in accordance with embodiments of the disclosure. Alternative to the attachment method as shown in FIG. 6A, the sleeve 228 can be disposed over and subsequently through the sealing collar 290 so that the entirety of the sealing collar 290 is covered by the sleeve 228. As shown, the hollow frustoconical inner member 210 is shown as a cross section inside a cross section of the cuff 206 of the glove 202. The sleeve 228 of the protective suit 102 is shown as traveling around the sealing collar 290 (shown in cross section), at a fold 298 of the sleeve 228. In this manner, the sealing collar 290 is protected from hazards, for example, chemical splashes, and the like. This method of attaching the glove 202 to the sleeve 228 obviates any need for an outer sleeve/double sleeve, as described above.

Figure 7:
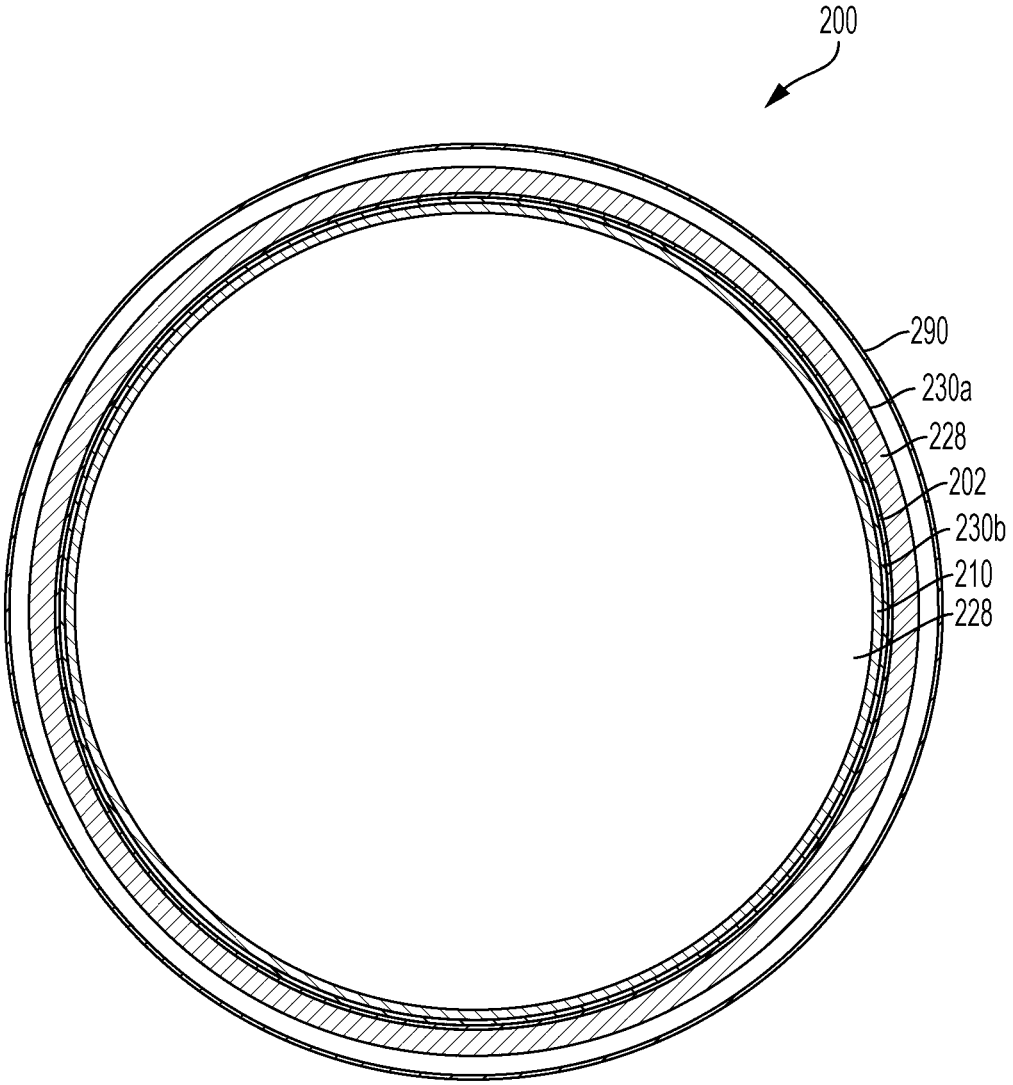
FIG. 7 shows a magnified view of a cross section of the assembled glove attachment system of FIG. 6A.

FIG. 7 shows a magnified view of a cross section of the assembled glove attachment system 200 of FIG. 6A. The sealing collar 290 having the rib 230*a* compresses the sleeve 228 with the glove 202 between the rib 230*b* of the hollow frustoconical inner member 210, leaving the hand opening 288. Because the glove 202 and the sleeve 228 extend in opposite directions, pulling on one, i.e., creating tension, only serves to make a seal between the hollow frustoconical inner member 210 and the sealing collar 290 tighter. Moreover, by making the hollow frustoconical inner member 210 ribbed with the ribs 230*b* and the sealing collar 290 having grooves 220*a*, the ribs 230 (disposed on either the hollow frustoconical inner member 210 and the sealing collar 290) of the glove attachment system 200 seals with at least one of the grooves 220 (disposed on either the hollow frustoconical inner member 210 and the sealing collar 290) and permits varying thicknesses of the sleeve 228 of the protective suit 102 and the glove 202. Furthermore, a "click feeling and sound," provides feedback when attaching the glove 202 to the protective suit 102 as well as a more accurate placement, i.e., reducing the risk of the sealing collar 290 from slipping down. A click may sound when detaching the glove 202 from the protective suit 102. It is to be further understood that the height of the ribs 230 and the depth of the grooves 220 permit a range of thicknesses of suits and gloves to be safely and reliably joined.

A variety of sizes/thicknesses of gloves and protective suits can be accommodated by the glove attachment system 200. Embodiments of the disclosure include a hollow frustoconical inner member 210 having, for example, an effective outer diameter of approximately 100-103 mm on a wide side and approximately 93-96 mm on a narrow side, which is measured across the ribs. Embodiments of the disclosure include a hollow frustoconical inner member 210 that is approximately 45-50 mm in length. Embodiments of the disclosure include a sealing collar 290 having an inner diameter measured across the ribs 230 that is approximately 101-104 mm across a wide side and approximately 94-96 mm across a narrow side. Embodiments of the disclosure include a sealing collar 290 that is approximately 25-30 mm in length. Each of the hollow frustoconical inner member 210 and the sealing collar 290 comprise a slant angle θ of approximately 80-84°. Accordingly, any of the grooves 220*a* of the sealing collar 290 can mate with any of the ribs 230*b* of the hollow frustoconical inner member 210 because of the differences in diameter, i.e., the hollow frustoconical inner member 210 and the sealing collar 290 can join a protective suit and glove of many differing thicknesses. In other words, a sealing collar 290 having a plurality of successively smaller diameters across the ribs 230*a*, disposed on an inner diameter, provides a variety of different coordinating ribs from the hollow frustoconical inner member with the grooves of the sealing collar 290. For example, a thick glove and/or protective suit can be joined if the diameter of a rib 230 of the hollow frustoconical inner member 210 is on the lower end of the spectrum, e.g., 94 mm while mating with a groove 220*a* of the sealing collar 290 that is on a wider end of the spectrum, e.g., 103 mm. In other words, a gap between 103 mm and 94 mm could accommodate a total thickness of a glove and a sleeve approximately 9 mm therebetween.

Similarly, if the diameter across a rib 230*b* of the hollow frustoconical inner member 210 is on the higher end of the spectrum, e.g., 96 mm while mating with a groove 220*a* of the sealing collar 290 that is on a lower end of the spectrum, e.g., 101 mm, the distance between the rib 230*b* and the groove 220*a* is 5 mm. The grooves 220*a* of the sealing collar 290 comprise a radius of approximately 1 mm. The ribs 230*b* of the hollow frustoconical inner member 210 comprise a radius of approximately 1.6 mm. Embodiments of the disclosure optionally contemplate a glove attachment system 200 in which the dimensions of the hollow frustoconical inner member 210 and the sealing collar 290 are smaller or larger so that smaller and larger articles can be releasably joined.

The hollow frustoconical inner member 210 and the sealing collar 290 may be made of any suitable material. For example, the hollow frustoconical inner member 210 and the sealing collar 290 may comprise steel, aluminum, various alloys, and the like. The hollow frustoconical inner member 210 and the sealing collar 290, according to any of the embodiments of the disclosure, comprise plastics materials, which may be semi-crystalline or amorphous materials. For example, suitable plastics materials include, at least, polyethylene, such as high density polyethylene (HDPE), polypropylene (PP), nylon 6, nylon 66, polybutylene terephthalate (PBT), polyacetal, polyvinyls, acrylonitrile-butadiene-styrene (ABS), styrene-acrylonitrile (SAN), and other suitable polymeric materials and/or blends or alloys thereof. Exemplary embodiments according to the disclosure include wherein the hollow frustoconical inner member 210 comprises HDPE and the sealing collar 290 comprises PP. The hollow frustoconical inner member 210 may comprises a rigid plastics material, such as ABS and the sealing collar 290 comprises a more resilient, flexible material, for example, a natural rubber or natural rubber blend, in any embodiment. A sealing collar 290 comprising natural rubber can be quite stiff yet compliant and resilient, creating a particularly tight seal in tension with the hollow frustoconical inner member 210. Furthermore, a sealing collar 290 made from a rubber material will comprise a high coefficient of friction, adding to the force needed to unlock the hollow frustoconical inner member 210 from the sealing collar 290. The hollow frustoconical inner member 210 and the sealing collar 290 need not be made of the same material.

The hollow frustoconical inner member 210 and the sealing collar 290 may be manufactured by injection molding processes or casting processes, as are known to those in the art. The injection molding processes or casting processes can produce hollow frustoconical inner members 210 and sealing collars 290 having particularly tight tolerances, e.g., +/−0.01-0.02 mm, providing tight seals in use.

Embodiments of the disclosure include a method for attaching a glove to a sleeve, comprising the step of placing a ribbed hollow frustoconical inner member into a glove; placing a sleeve over the glove; and placing a sealing collar having grooves over the sleeve, wherein at least one of the ribs of the hollow frustoconical inner member mate with at least one of the grooves of the sealing collar, forming a seal that releasably joins the sleeve to the glove.

Embodiments of the disclosure comprise an alternative method for attaching a glove to a sleeve, comprising the steps of placing a ribbed hollow frustoconical inner member into a glove; placing a sleeve over the glove; and placing the sleeve over a sealing collar and through a center of the sealing collar, wherein at least one of the ribs of the hollow frustoconical inner member mate with at least one of the grooves of the sealing collar, forming a seal that releasably joins the sleeve to the glove.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more.

The foregoing description of embodiments of the disclosure comprises a number of elements, devices, machines, components and/or assemblies that perform various functions as described. These elements, devices, machines, components and/or assemblies are exemplary implementations of means for performing their respectively described functions.

Although only a non-exhaustive description of exemplary embodiments of the present disclosure have been detailed above, those skilled in the art will readily appreciate that many modifications to the sizes of the ribs, grooves, slant angles, diameters, and the like are possible in the exemplary embodiments without materially departing from the novel teachings and advantages of this disclosure.

The invention claimed is:

1. A glove attachment system, comprising:

a hollow frustoconical inner member having a plurality of ribs and a plurality of grooves disposed on a tapered external surface of the hollow frustoconical inner member, the hollow frustoconical inner member having a tapered outer diameter having a smaller diameter at a first end of the hollow frustoconical inner member than at a second end of the hollow frustoconical inner member, and wherein the hollow frustoconical inner member has an inner diameter that is smaller at the first end of the hollow frustoconical inner member than at the second end of the hollow frustoconical inner member; and a hollow frustoconical sealing collar having a first open end and a second open end opposite the first open end and a plurality of ribs and a plurality of grooves disposed on a tapered internal surface of the sealing collar, the sealing collar having an inner diameter larger than the tapered outer diameter of the hollow frustoconical inner member, wherein the plurality of ribs and the plurality of grooves of the hollow frustoconical inner member and the plurality of ribs and the plurality of grooves of the sealing collar are configured to mate and releasably join a sleeve and a glove that are radially compressed between the plurality of ribs and the plurality of grooves of the hollow frustoconical member and the plurality of ribs and the plurality of grooves of the sealing collar, wherein the sleeve and the glove are separately formed and extend in opposite directions.

2. The glove attachment system of claim 1, wherein the ribs of the plurality of ribs are concentric.

3. The glove attachment system of claim 2, wherein diameters measured across the plurality of concentric ribs are progressively larger from the first end of the hollow frustoconical inner member to the second end of the hollow frustoconical inner member.

4. The glove attachment system of claim 1, wherein the hollow frustoconical inner member has an inner surface that is tapered from the first end of the hollow frustoconical inner member to the second end of the hollow frustoconical inner member.

5. The glove attachment system of claim 2, wherein diameters measured across the plurality of concentric ribs of the sealing collar are progressively larger from the first open end of the sealing collar to the second open end of the sealing collar.

6. The glove attachment system of claim 1, wherein the sealing collar has a plurality of rails extending radially outwardly from an external surface of the sealing collar.

7. The glove attachment system of claim 1, wherein the sleeve is part of at least one of a Level A-Level D chemical suit, EN type 1-6 chemical suit, a fume hood, a biosafety cabinet, or a glove box.

8. The glove attachment system of claim 1, further comprising:

a glove and a sleeve disposed between the hollow frustoconical inner member inner member and the sealing collar.

9. A method of using the glove attachment system of claim 1, comprising:

placing the hollow frustoconical inner member into a glove;

placing a sleeve over the glove; and placing the hollow frustoconical sealing collar over the sleeve thereby compressing the sleeve and the glove radially between the plurality of ribs and the plurality of grooves of the hollow frustoconical inner member and the plurality of ribs and the plurality of grooves of the hollow frustoconical sealing collar to join the sleeve and the glove, forming a seal that releasably joins the sleeve to the glove.

10. The method of claim 9, wherein the sleeve is part of at least one of a Level A-Level D chemical suit, EN type 1-6 chemical suit, a fume hood, a biosafety cabinet, or a glove box.

11. The method of claim 9, wherein the sealing collar has rails on an external surface.

12. A method of using the glove attachment system of claim 1, comprising:

placing the ribbed hollow frustoconical inner member into a glove;

placing a sleeve over the glove; and placing the sleeve over the hollow frustoconical sealing collar and through a center of the hollow frustoconical sealing collar thereby at least partially disposing and compressing the sleeve and the glove radially between the ribs of the hollow frustoconical inner member and the grooves of the hollow frustoconical sealing collar forming a seal that releasably joins the sleeve to the glove.

13. The method of claim 12, wherein the sleeve is part of a Level A-Level D or EN type 1-6 chemical suit.

14. The method of claim 12, wherein the sealing collar has rails on an external surface.

15. The method of claim 12, wherein the sleeve is part of a fume hood, a biosafety cabinet, or a glove box.

16. The method of claim 12, wherein the ribs of the ribbed hollow frustoconical inner member are concentric.

17. The method of claim 16, wherein diameters measured across the plurality of concentric ribs are progressively larger from the first end of the hollow frustoconical inner member to the second end of the hollow frustoconical inner member.

* * * * *